US009909351B1

(12) United States Patent
McNabb

(10) Patent No.: US 9,909,351 B1
(45) Date of Patent: Mar. 6, 2018

(54) GARAGE DOOR OPENER SYSTEM AND METHOD OF OPERATING A GARAGE DOOR OPENER SYSTEM

(71) Applicant: TTI (MACAO COMMERCIAL OFFSHORE) LIMITED, Macau (MO)

(72) Inventor: William Marcus McNabb, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 15/462,069

(22) Filed: Mar. 17, 2017

(51) Int. Cl.

| | |
|---|---|
| ***E05F 15/00*** | (2015.01) |
| ***E05F 15/78*** | (2015.01) |
| ***E05F 15/668*** | (2015.01) |
| ***E05F 15/79*** | (2015.01) |
| ***E05B 47/00*** | (2006.01) |
| ***E05B 37/00*** | (2006.01) |
| ***E05B 49/00*** | (2006.01) |
| ***E05B 65/00*** | (2006.01) |
| ***G07C 9/00*** | (2006.01) |

(52) U.S. Cl.
CPC ..... *E05F 15/78* (2015.01); *E05B 37/00* (2013.01); *E05B 47/0001* (2013.01); *E05B 49/006* (2013.01); *E05B 65/0021* (2013.01); *E05F 15/668* (2015.01); *E05F 15/79* (2015.01); *G07C 9/00309* (2013.01); *E05B 2047/0015* (2013.01); *E05B 2047/0067* (2013.01); *E05B 2047/0072* (2013.01); *G07C 2009/00785* (2013.01); *G07C 2009/00928* (2013.01)

(58) Field of Classification Search
CPC ..... E05F 15/78; E05F 15/668; E05F 15/79; E05B 65/0021; E05B 47/0001; E05B 37/00; E05B 49/006; E05B 2047/0015; E05B 2047/0067; E05B 2047/0072; G07C 9/00309; G07C 2009/00785; G07C 2009/00928; G08C 17/02; G08C 2201/92
See application file for complete search history.

(56) References Cited

U.S. PATENT DOCUMENTS

| | | | | |
|---|---|---|---|---|
| 4,429,299 A | | 1/1984 | Kabat | |
| 4,954,810 A | * | 9/1990 | Llewellyn | E05F 15/77 340/539.1 |
| 5,491,463 A | | 2/1996 | Sargeant | |
| 5,751,224 A | * | 5/1998 | Fitzgibbon | G07C 9/00182 160/188 |

(Continued)

*Primary Examiner* — Brian Miller
(74) *Attorney, Agent, or Firm* — Michael Best & Friedrich LLP

(57) ABSTRACT

A garage door opener system having a garage door opener and a remote input device electrically connected to the garage door opener by an electrical conductor. The remote input device receives power by the electrical conductor. The remote input device includes a device controller to communicate an event message, monitor for an acknowledgement message within a time period, and repeat the event message when the acknowledgement message is not received within a time period. The garage door opener includes a master controller. The master controller receives the event message and communicates the acknowledgement message in response to receiving the event message. Also disclosed is a method of operating the garage door opener system.

20 Claims, 11 Drawing Sheets

(56) References Cited

U.S. PATENT DOCUMENTS

| | | | | |
|---|---|---|---|---|
| 5,926,106 | A * | 7/1999 | Beran | G07C 9/00111 327/261 |
| 6,081,203 | A | 6/2000 | Fitzgibbon | |
| 6,565,110 | B1 | 5/2003 | Holzer | |
| 6,624,605 | B1 | 9/2003 | Powder | |
| 6,737,968 | B1 | 5/2004 | Ergun | |
| 6,961,763 | B1 | 11/2005 | Wang | |
| 6,987,444 | B2 | 1/2006 | Bub | |
| 7,133,729 | B1 | 11/2006 | Wang | |
| 7,151,351 | B2 | 12/2006 | Piechowiak | |
| 7,161,319 | B2 | 1/2007 | Ergun | |
| 7,183,732 | B2 * | 2/2007 | Murray | E05F 15/668 318/280 |
| 7,397,342 | B2 * | 7/2008 | Mullet | G07C 9/00182 340/12.5 |
| 7,750,890 | B2 * | 7/2010 | Fitzgibbon | G07C 9/00182 340/5.71 |
| 8,421,591 | B2 | 4/2013 | Karasek | |
| 8,675,838 | B2 | 3/2014 | Gioia | |
| 2004/0039973 | A1 | 2/2004 | Bub | |
| 2004/0217860 | A1 | 11/2004 | Ergun | |
| 2004/0239496 | A1 * | 12/2004 | Fitzgibbon | G07C 9/00182 340/539.1 |
| 2007/0096872 | A1 * | 5/2007 | Nguyen | G06F 21/305 340/5.61 |
| 2010/0052846 | A1 | 3/2010 | Wang | |
| 2015/0275564 | A1 * | 10/2015 | Rosenthal | E05F 15/77 700/275 |

* cited by examiner

GARAGE DOOR OPENER SYSTEM AND METHOD OF OPERATING A GARAGE DOOR OPENER SYSTEM

BACKGROUND

The invention relates to a method and system for communicating by use of a power line, such as between a garage door opener and a keypad for the garage door opener.

SUMMARY

The invention provides, in one embodiment, a garage door opener system having a garage door opener and a keypad electrically connected to the garage door opener. The garage door opener and the keypad are connected by a wire. The garage door opener powers the keypad via the wire. The keypad transmits input to the garage door opener via the wire and the garage door opener provides status information to the keypad via the wire.

In another embodiment, the invention provides a method for communicating between a garage door opener and a keypad. The method includes powering the keypad with power from the garage door opener by a wire; receiving, via the keypad, an input; transmitting the input to the garage door opener from the keypad via the wire; receiving the input at the garage door opener; transmitting an acknowledgement to the keypad from the garage door opener via the wire; and receiving the acknowledgement at the keypad.

In yet another embodiment, the invention provides a garage door opener system having a structure, a motor supported by the structure and capable of moving a garage door, a power supply supported by the structure and connectable to an external power source, and a remote input device electrically connectable to the power supply by an electrical conductor. The remote input device receives power by the electrical conductor. The remote input device includes a device controller to communicate an event message, monitor for an acknowledgement message within a time period, and repeat the event message when the acknowledgement message is not received within a time period. The garage door opener system further includes a master controller supported by the structure, connected to the motor and the power supply, and electrically connectable to the remote input device by the electrical conductor. The master controller receives the event message and communicates the acknowledgement message in response to receiving the event message.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
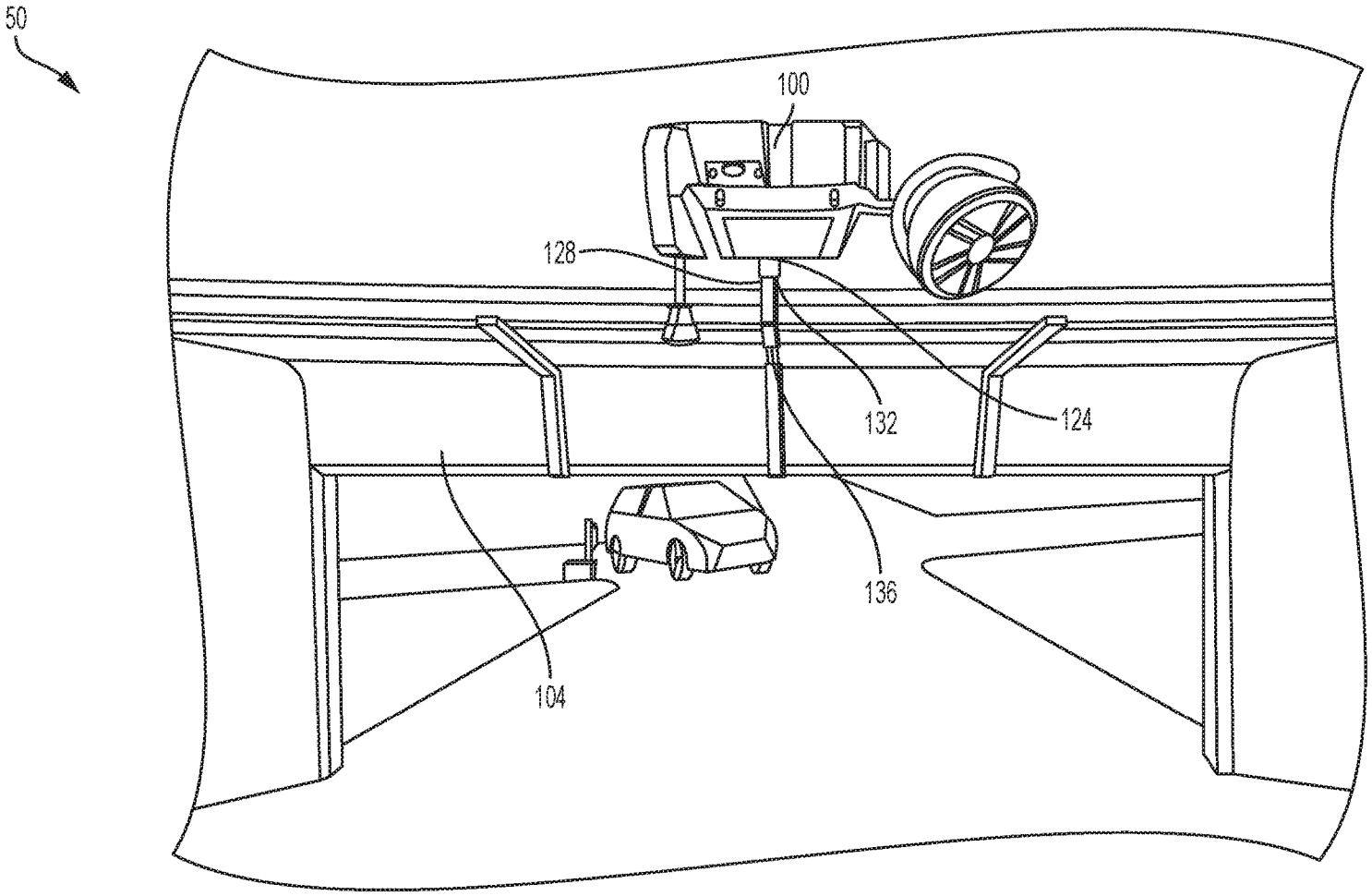
FIG. 1 is a view of a garage door opener system.
Figure 2:
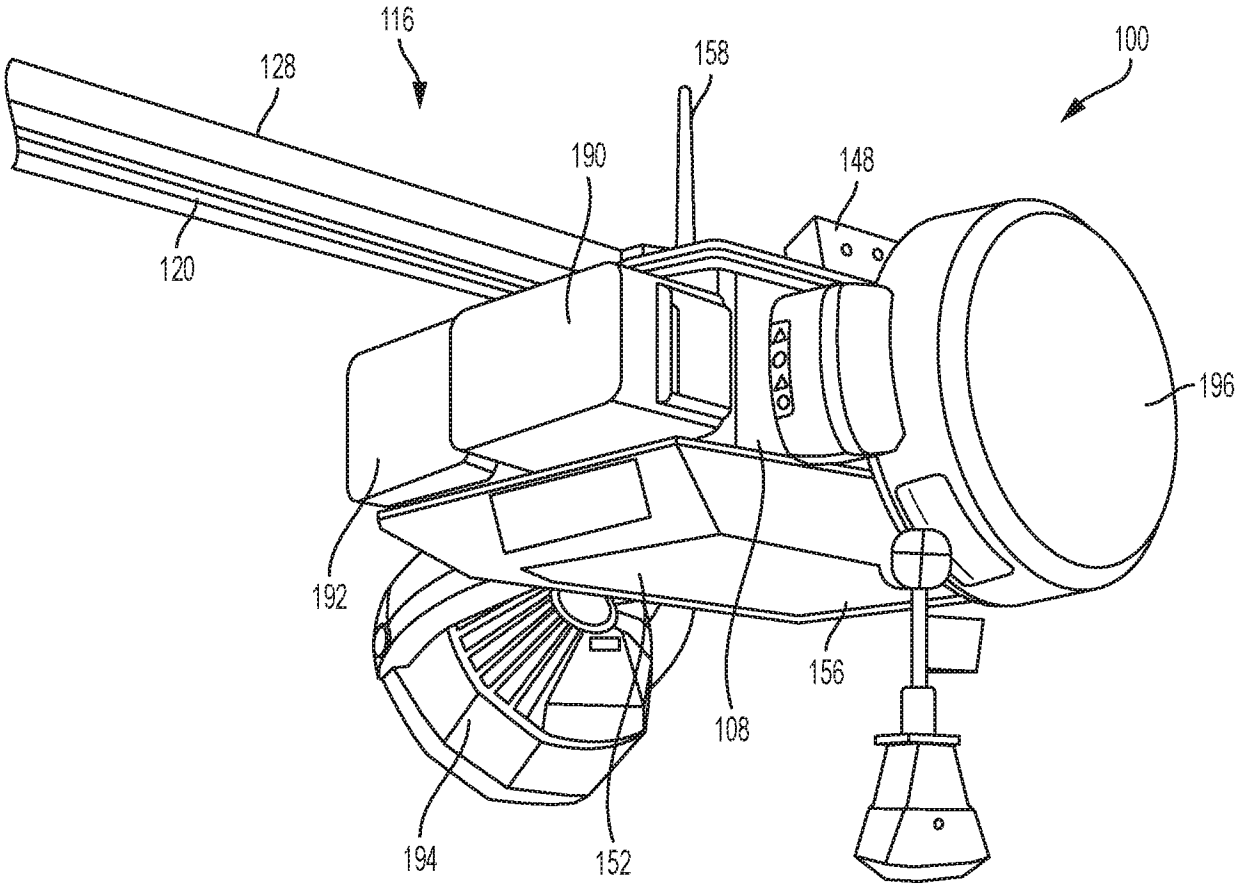
FIG. 2 is a view of a garage door opener of the garage door system in FIG. 1.

FIG. 1 and FIG. 2 illustrate a garage door system 50 including a garage door opener 100 operatively coupled to a garage door 104. The garage door opener 100 includes a structure, e.g., a housing 108, supporting a motor that is operatively coupled to a drive mechanism 116. The drive mechanism 116 includes a transmission coupling the motor to a drive chain 120 having a shuttle 124 configured to be displaced along a rail assembly 128 upon actuation of the motor. The shuttle 124 may be selectively coupled to a trolley 132 that is slidable along the rail assembly 128 and coupled to the garage door 104 via an arm member.

The trolley 132 is releasably coupled to the shuttle 124 such that the garage door system 50 is operable in a powered mode and a manual mode. In the powered mode, the trolley 132 is coupled to the shuttle 124 and the motor is selectively driven in response to actuation by a user (e.g., via a remote input device such as a key pad or wireless remote in communication with the garage door opener 100). As the motor is driven, the drive chain 120 is driven by the motor along the rail assembly 128 to displace the shuttle 124 (and, therefore, the trolley 132), thereby opening or closing the garage door 104. In the manual mode, the trolley 132 is decoupled from the shuttle 124 such that a user may manually operate the garage door 104 to open or close without resistance from the motor. The drive mechanism 116 can be different for other garage door systems.

The housing 108 is coupled to the rail assembly 128 and a surface above the garage door (e.g., a garage ceiling or support beam) by, for example, a support bracket 148. The garage door opener further includes a light unit 152 including a light (e.g., one or more light emitting diodes (LEDs)) enclosed by a transparent cover or lens 156. The light unit 152 may either be selectively actuated by a user or automatically powered upon actuation of the garage door opener 100.

The garage door opener 100 further includes an antenna 158 enabling the garage door opener 100 to communicate wirelessly with other devices, such as a smart phone or network device (e.g., a router, hub, or modem) or a wireless opener. The garage door opener 100 is also configured to receive, control, and/or monitor a variety of accessory devices, such as a backup battery unit 190, a speaker 192, a fan 194, an extension cord reel 196, among others.

Figure 3A:
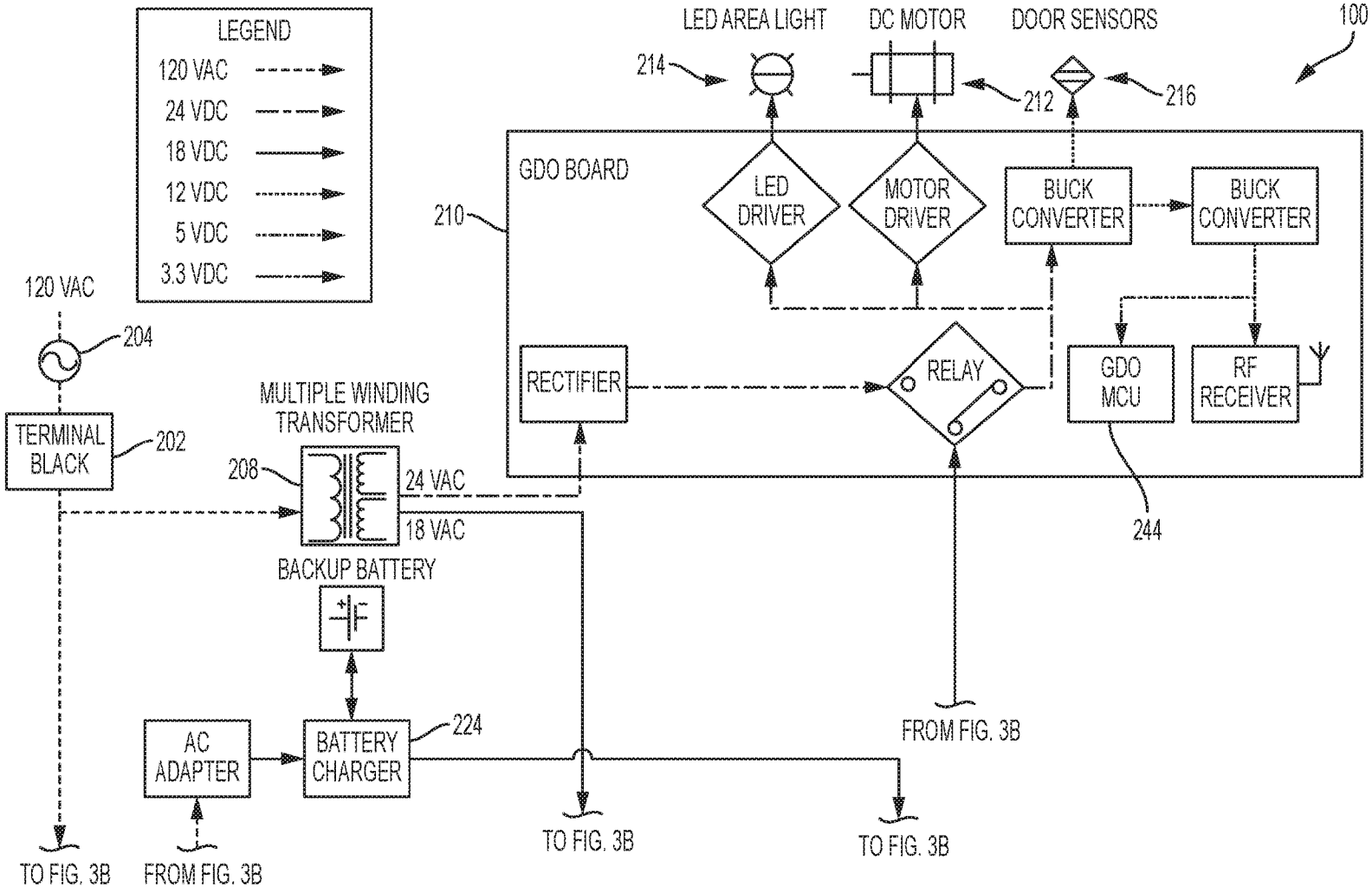
FIG. 3A is a first partial block power diagram of the garage door opener of FIG. 2.
Figure 3B:
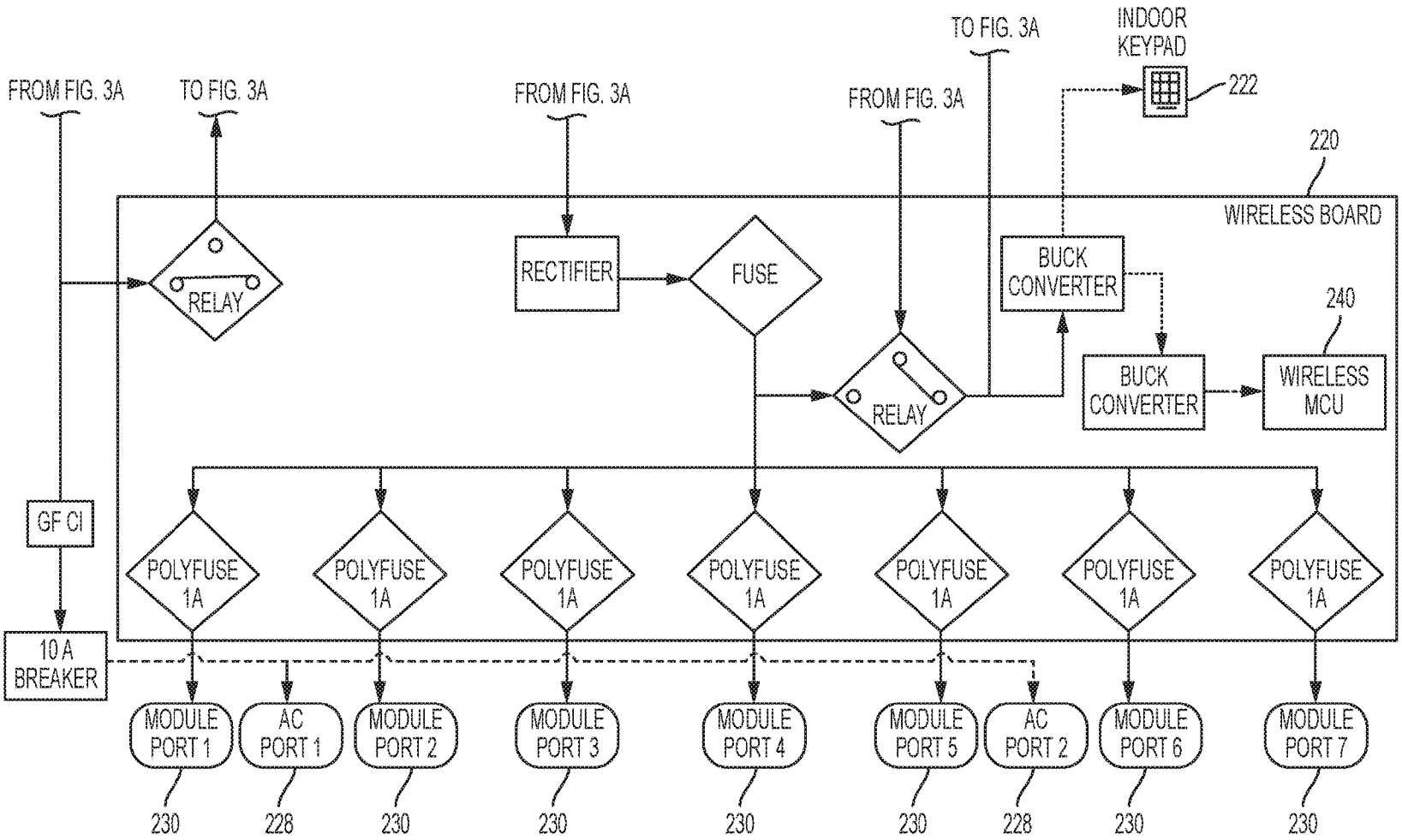
FIG. 3B is a second partial block power diagram of the garage door opener of FIG. 2.

FIG. 3A and FIG. 3B illustrate a block power diagram of the garage door opener 100. The garage door opener 100 includes a terminal block 202 configured to receive power from an external power source 204, such as a standard 120 VAC power outlet. The terminal block 202 directs power, via a transformer 208, to a garage door opener (GDO) board 210 for supply to components thereof as well as a motor 212 (used to drive the drive mechanism 116), LEDs 214 (of the light unit 152), and garage door sensors 216. The terminal block 202 further directs power via the transformer 208 to a wireless board 220 and components thereof, as well as a wired keypad 222 and module ports 230. The terminal block 202 also directs power to a battery charger 224 and AC ports 228. Accordingly, the terminal block 202 in combination with other elements (e.g., the transformer 208, rectifiers, etc.) supply multiple voltages. The module ports 230 are configured to receive various accessory devices, such as a speaker, a fan, an extension cord reel, a parking assist laser, an environmental sensor, a flashlight, and a security camera. One or more of the accessory devices are selectively attachable to and removable from the garage door opener 100, and may be monitored and controlled by the garage door opener 100.

The wireless board 220 includes a wireless microcontroller 240, among other components. The GDO board 210 includes, among other components, a garage door opener (GDO) microcontroller 244 and a radio frequency (RF) receiver 246. The wireless board 220 and the GDO board 210 can be combined as a single board, and the microcontroller 240 and the microcontroller 244 can be combined as a single microcontroller. The terminology, e.g., GDO wireless, the number of boards, and the number of microcontrollers are exemplary.

The microcontrollers 240 and 244 (and the later described microcontroller 435) can include processors configured to carry out the functionality described herein attributed thereto via execution of instructions stored on a non-transitory computer readable medium (e.g. one of the illustrated memories), can include hardware circuits (e.g., an application specific integrated circuit (ASIC) or field programmable gate array) configured to perform the functions, or a combination thereof.

Figure 4:
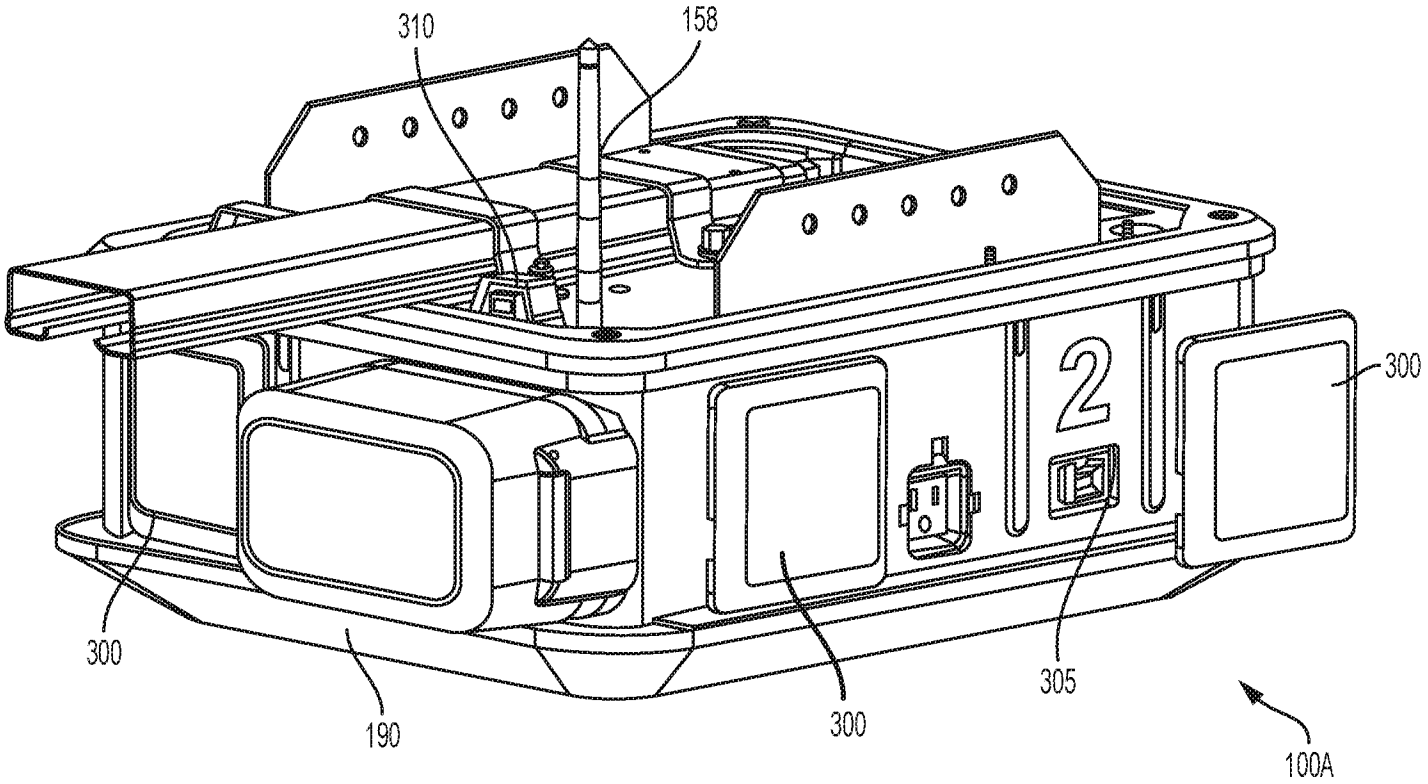
FIG. 4 is a view of the garage door opener of FIG. 2 in a second configuration.
Figure 5:
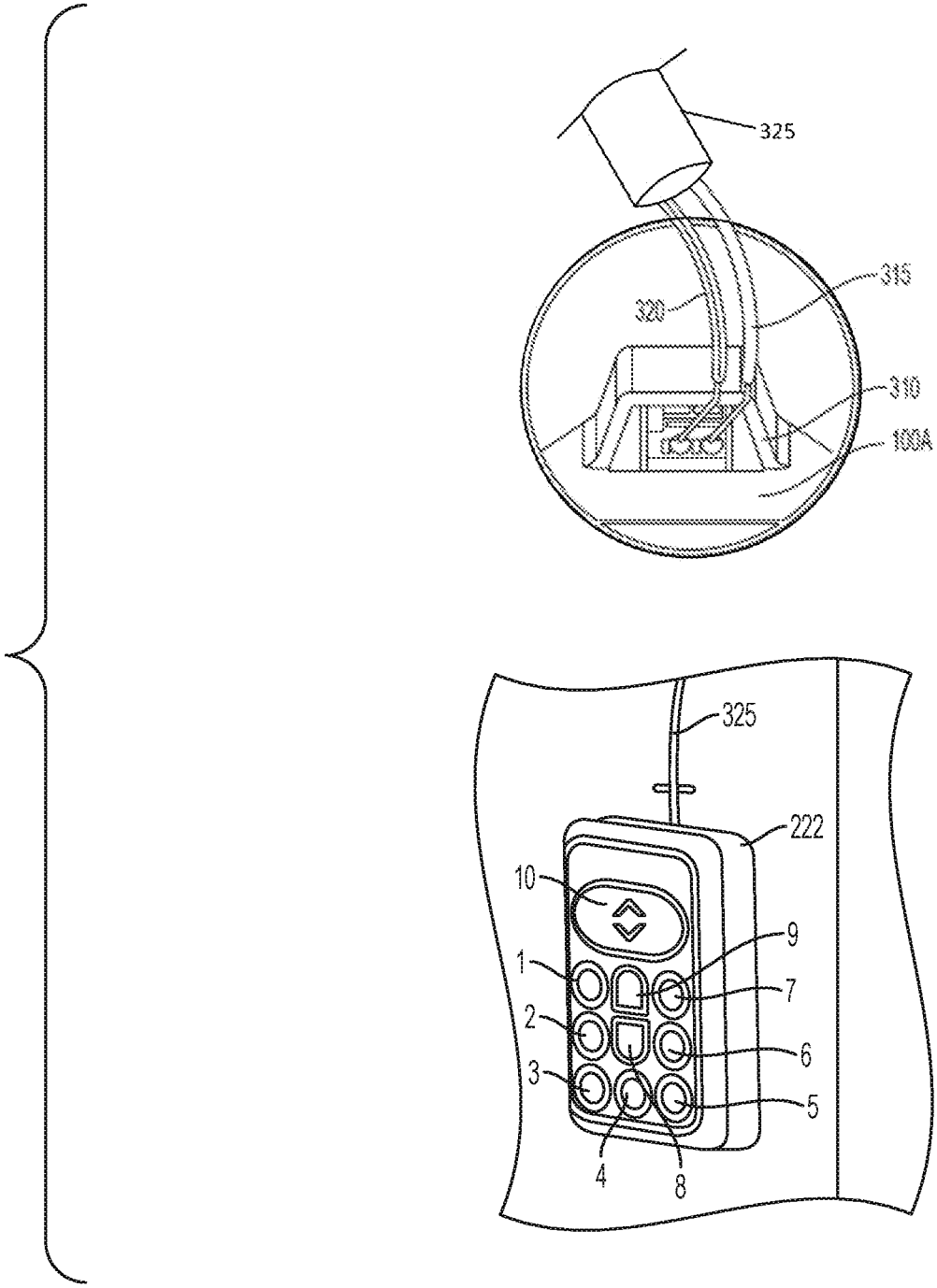
FIG. 5 is a view of a keypad wire terminal and a keypad.

FIG. 4 shows the garage door opener 100A in a second configuration. The second configuration shows the garage door opener 100A having module port covers 300 covering module ports 305. The module ports 305 power the accessory devices, discussed above, when the accessory devices are connected to the garage door opener 100A, such as shown in FIG. 2. Also shown in FIG. 4 is a wire terminal 310 for coupling the keypad 222 to the garage door opener 100A. FIG. 5 shows an electrical conductor (e.g., wires 315 and 320 of a cord 325) coupled to the wire terminal 310. The cord 325 is coupled to the keypad 222, as shown in FIG. 5. The cord 325 provides power and data between the wireless board 220 and the keypad 222.

The keypad 222 detects user input via the interface keys and informs the microcontrollers 240 and/or 244 of the selection. The keypad 222 also sets an LED state based on information from the garage door opener 100.

The keypad 222 detects a key selection event when a button or key is pressed and released in less than 500 milliseconds (ms). The time period, 500 ms, is exemplary and can vary for other garage door opener systems. For the example shown, the keys include DC ports 1 through 7, lock 8, light on/off 9, and door up/down 10. The buttons DC ports 1 through 7 result in the connection (i.e., make) and disconnection (i.e., break) of DC power to the accessory devices connected to the respective ports. The lock button 8 "locks" the garage door opener 100/100A from opening or closing the garage door 104. The light on/off 9 button turns the light unit 152 on or off. The door up/down button 10 causes the garage door opener 100/100A to move the garage door 104 up or down.

The keypad 222 detects a key hold event when a button is pressed and held for longer than 500 ms. The time period, 500 ms, is exemplary and can vary for other garage door systems. In some operations, the key hold event may be for a limited number of keys. For example, in one implementation, only the door up/down button 10 may have a key hold event.

The keypad 222 communicates any detected events to the garage door opener 100/100A. Also, the keypad sets an LED state of the keypad based on an acknowledgement message from the garage door opener 100/100A. An exemplary LED operation for the keypad 222 is shown below in table T1.

TABLE T1

| LED Operation | | | |
|---|---|---|---|
| Event | Mode | Door LED | Lock LED |
| None | Vacation Disabled | Solid ON | Solid ON |
| | Vacation Enabled | 0.5 Hz Fade | 0.5 Hz Fade |
| | Backup Power | OFF | OFF |
| Door button select | Vacation Disabled | OFF for 0.5 sec, then Solid ON | Solid ON |
| | Vacation Enabled | OFF for 0.5 sec, then 0.5 Hz Fade | 0.5 Hz Fade |
| | Backup Power | OFF | OFF |
| Module, Light, or Lock button select | Vacation Disabled | Solid ON | OFF for 0.5 sec, then Solid ON |
| | Vacation Enabled | 0.5 Hz Fade | OFF for 0.5 sec, then 0.5 Hz Fade |
| | Backup Power | OFF | OFF |

Figure 6:
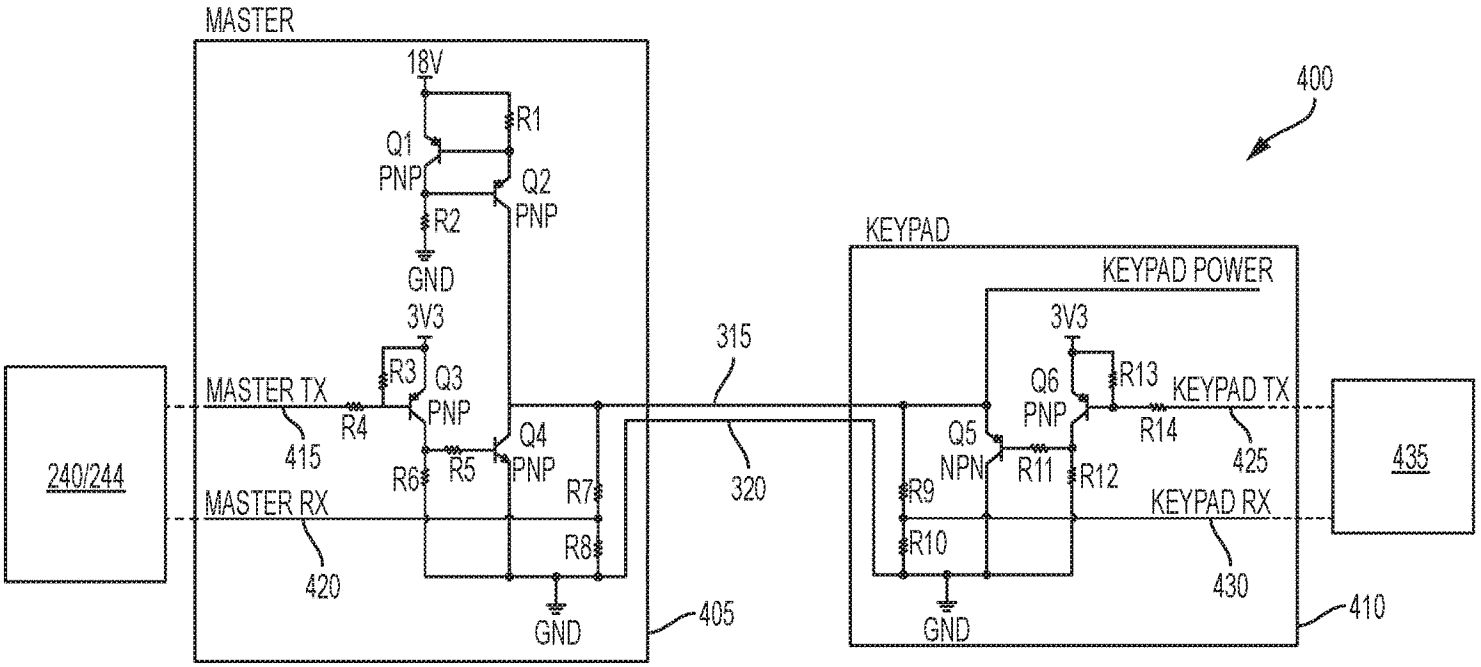
FIG. 6 is a circuit diagram of a power/communication circuit used in the garage door system of FIG. 1.

FIG. 6 shows a power/communication circuit 400. The circuit 400 includes a master power/communication circuit 405 and a keypad power/communication circuit 410. As shown in FIG. 6, DC power is provided from the garage door opener 100/100A via transistors Q1 and Q2; and resistors R1, R2, R7, and R8. The master power/communication circuit 405 and the keypad power/communication circuit 410 transmit and receive signals via a master transmit line 415, a master receive line 420, keypad transmit line 425, and keypad receive line 430. The master transmit line 415 and the master receive line 420 are electrically connected to one of the microcontrollers 240 or 244. The keypad transmit line 425 and the keypad receive line 430 are electrically connected to a microcontroller 435 of the keypad. The communication circuit for the master power/communication circuit 405 includes transistors Q3, Q4; and resistors R3, R4, R5, R6, R7, and R8. The corresponding communication circuit for the keypad power/communication circuit 410 includes transistors Q5, Q6; and resistors R9, R10, R11, R12, R13, and R14.

Figure 7:
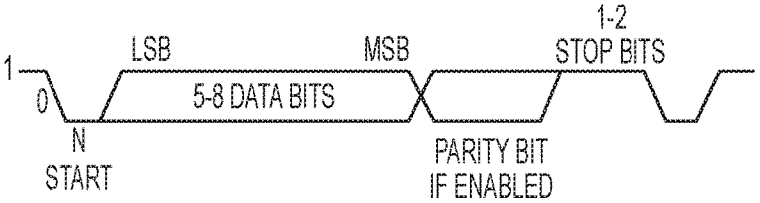
FIG. 7 is a diagram of a data frame structure used in the power/communication circuit of FIG. 6.

The transmission rate among the microcontrollers 435 and 240/244 in one construction can be 9600 baud, and follows a data transmission with a least significant bit start and even parity check. FIG. 7 shows an exemplary frame structure. In one communication structure, the start is 1 bit and is a low signal, data is communicated over the next 8 bits, a parity bit is then communicated, and a stop bit is communicated as a high signal.

In one operation, the keypad 222 includes two types of key selection events: press and hold. Every key on the keypad 222 registers a press event if a button is held for less than 500 ms, for example. When a press event is detected, the keypad 222 transmits a data frame to inform the garage door opener 100/100A of the key selection.

After transmitting the event message, the keypad 222 waits for an acknowledgement message. The acknowledgment message from the garage door opener 100/100A indicates that the data was correctly received and also indicates the state of a keypad LED. If 100 ms, which is an exemplary time period, passes without a received acknowledgement message, then the keypad 222 resends the state. The keypad 222 will attempt to resend the state multiple times (e.g. two times) before stopping and returning to monitor for additional key events.

The second type of key selection event, hold, applies, in one implementation, only to the door up/down key. If the door up/down key is held for more than 500 ms, which is an exemplary time period, then the keypad will transmit an event message representing the hold every 100 ms, which is an exemplary time period, until the key is released. If the keypad 222 does not detect any key selection events, then it will send a heartbeat or ping message to the master every 500 ms, which is an exemplary time period. FIGS. 8-13 shows exemplary messages for the keypad.

Figure 9:
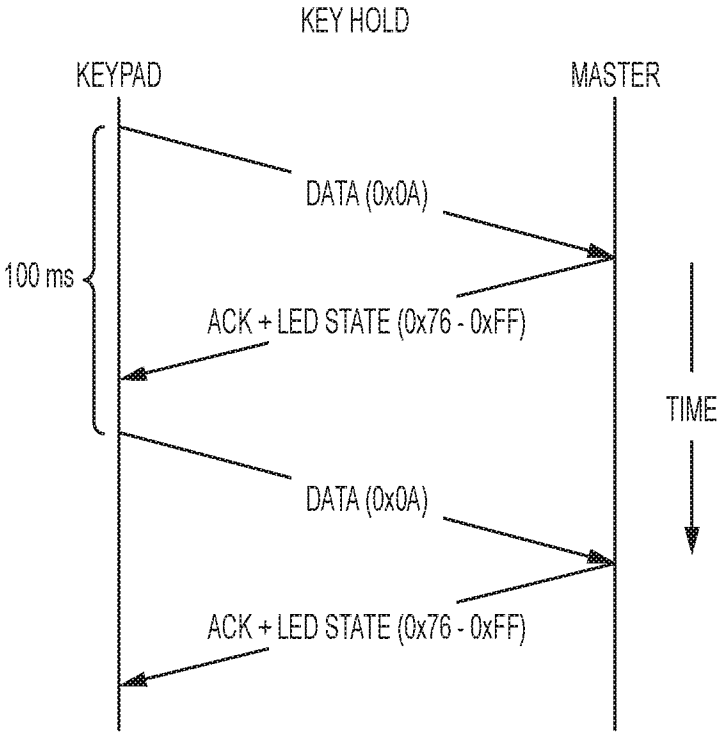
FIG. 9 is a second data flow diagram over the power/communication circuit of FIG. 6.
Figure 8:
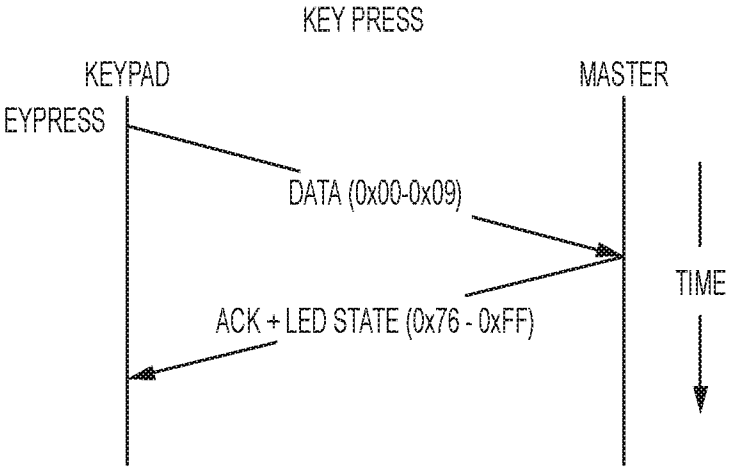
FIG. 8 is a first data flow diagram over the power/communication circuit of FIG. 6.
Figure 11:
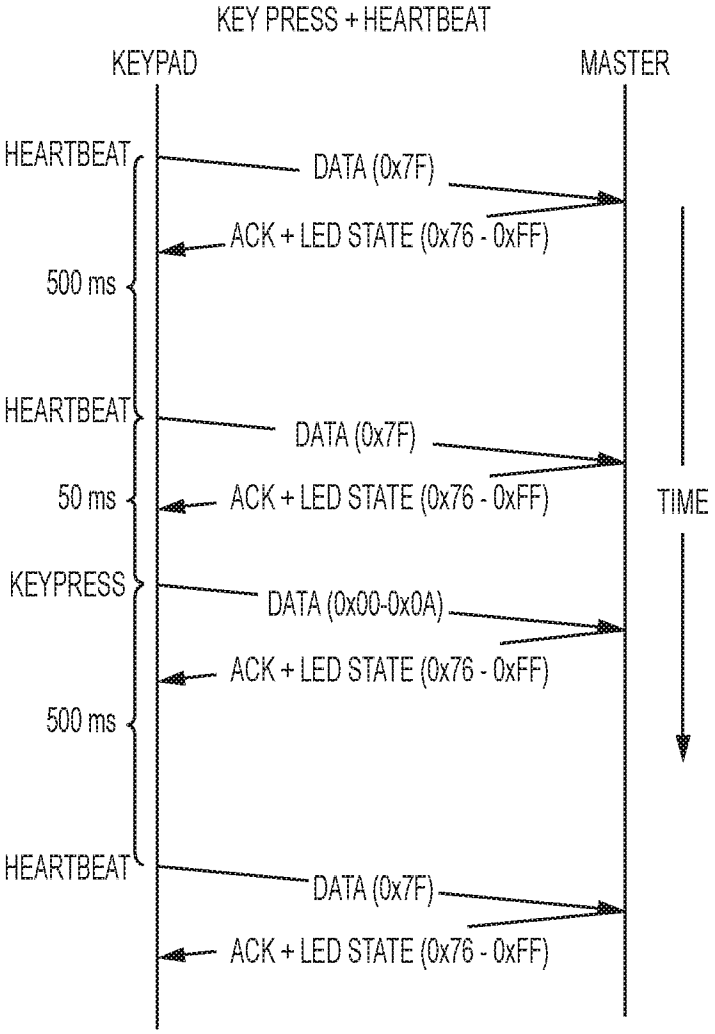
FIG. 11 is a fourth data flow diagram over the power/communication circuit of FIG. 6.
Figure 10:
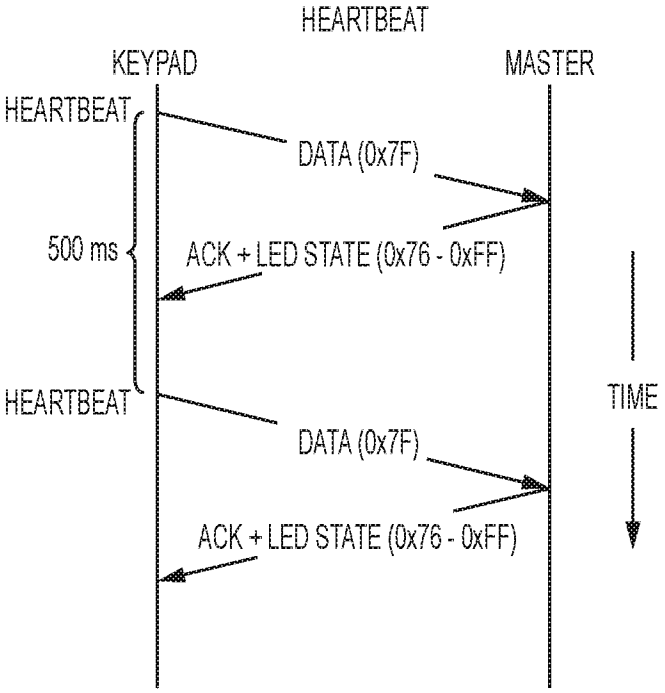
FIG. 10 is a third data flow diagram over the power/communication circuit of FIG. 6.
Figure 13:
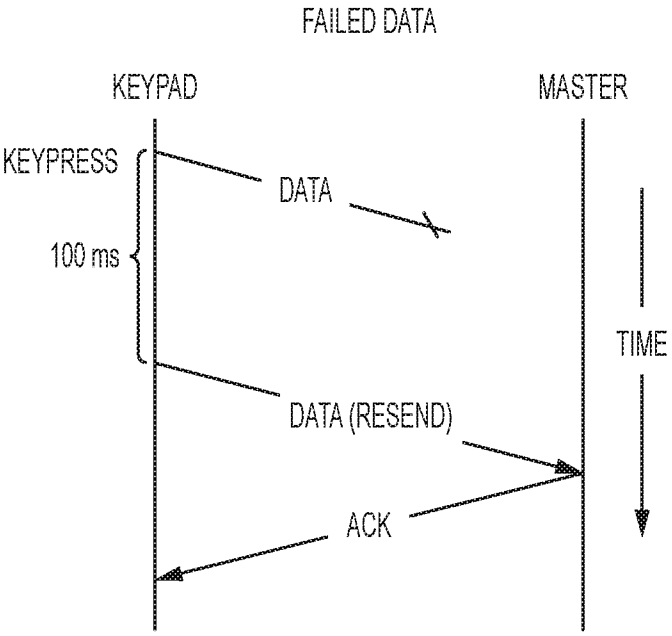
FIG. 13 is a sixth data flow diagram over the power/communication circuit of FIG. 6.
Figure 12:
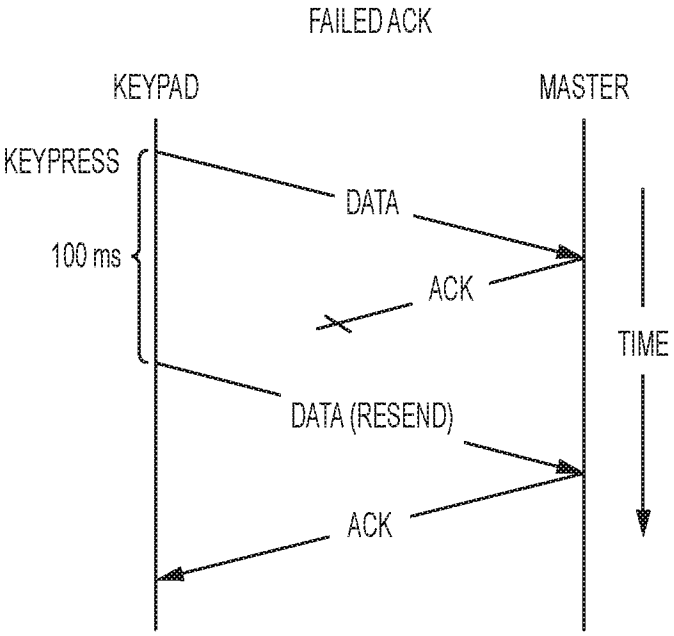
FIG. 12 is a fifth data flow diagram over the power/communication circuit of FIG. 6.

FIG. 8 shows a data flow diagram for a key press. FIG. 9 shows a data flow diagram for a key hold. FIG. 10 shows a data flow diagram for multiple heartbeat events. FIG. 11 shows a data flow diagram for a key press and a heartbeat event. FIG. 12 shows a data flow diagram for a failed acknowledgement message followed by a resent data transmission. FIG. 13 shows a data flow diagram for a failed data transmission followed by a resent data transmission.

Figure 14:
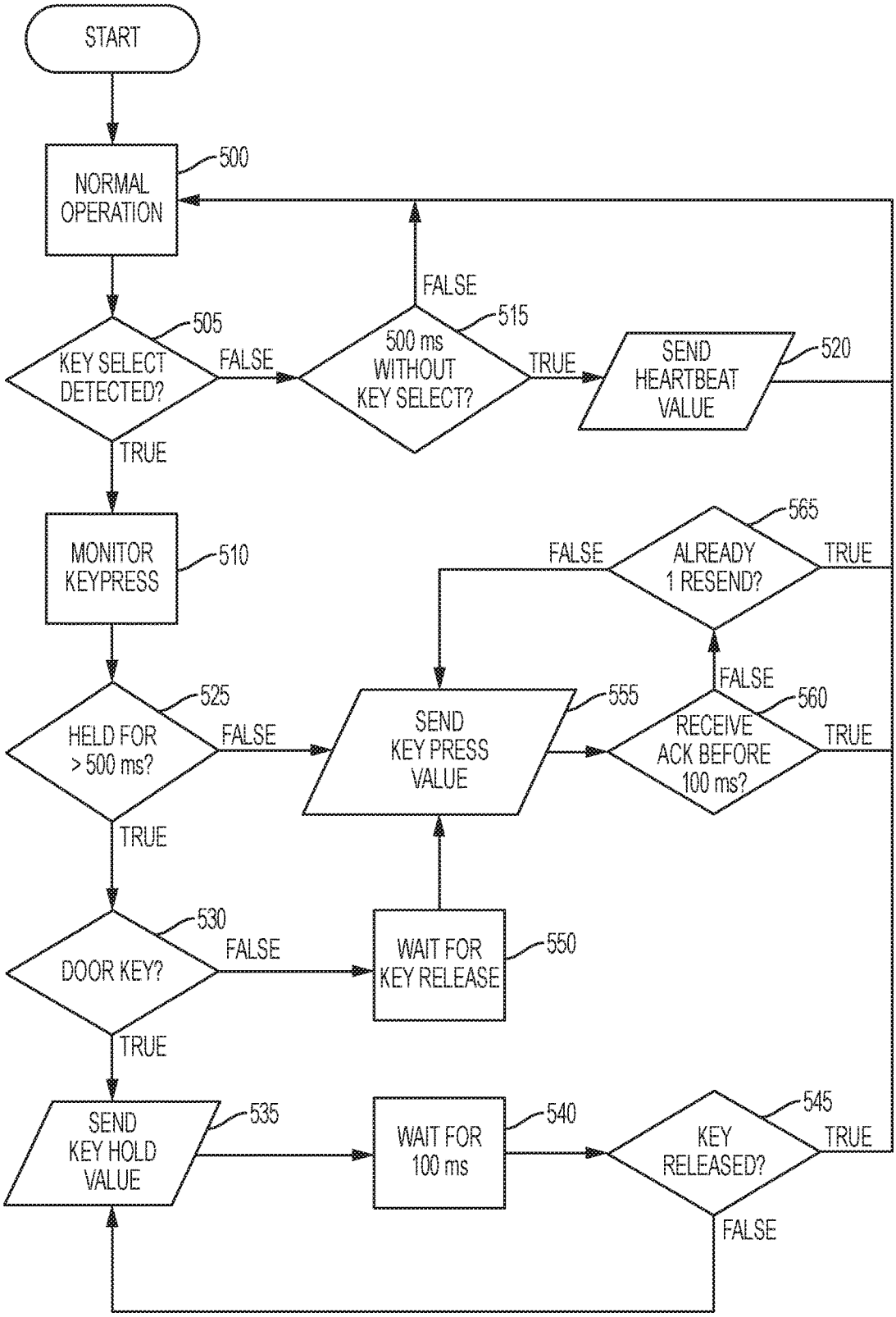
FIG. 14 is a flow chart of a method of communicating over a power line.

FIG. 14 shows a flowchart for keypad communication operation. At block 500, normal operation occurs until an interrupt causes the flow to proceed to block 505. At block 505, the keypad 222 determines whether a key select has been detected. If true, the keypad 222 monitors the selected button (block 510). If false, then the keypad 222 determines whether 500 ms has passed without a key select (block 515). If 500 ms has passed, then the keypad 222 sends a heartbeat data message (block 520). Otherwise, the procedure returns to block 500. At block 525, the keypad 222 determines whether the monitored key press is for greater than 500 ms. If yes, then the keypad determines whether the door button 10 has been pressed (block 530). If the door button 10 has been held, then the keypad 222 transmits a keyhold message (block 535), waits 100 ms (block 540), and determines whether the door button 10 has been released (block 545). If the door button 10 has not been released, then the process returns to block 535. Otherwise, the process proceeds to block 500. At block 550, the keypad waits for the button release and proceeds to block 555. At block 555, the keypad 222 sends the pressed key message. At block 560, the keypad 222 determines whether an acknowledgement message has been received within 100 ms. If yes, the process returns to block 500. Otherwise, the keypad 222 determines whether the key press message should be resent again (block 565). Depending on the decision, the process proceeds to either block 500 or block 555.

Although the method described in FIG. 14 is disclosed as a series of ordered steps, in some operations, one or more of the steps of the method are carried out in a different order, in parallel, or both. Additionally, in some embodiments, one or more steps of the method are not included, such as block 565.

Although the invention has been described in detail with reference to certain preferred embodiments, variations and modifications exist within the scope and spirit of one or more independent aspects of the invention as described.

What is claimed is:

1. A garage door opener system comprising:

a structure;

a motor supported by the structure and capable of moving a garage door;

a power supply supported by the structure and connectable to an external power source;

a remote input device electrically connectable to the power supply by an electrical conductor, the remote input device to receive power by the electrical conductor, the remote input device including a device controller to communicate an event message, monitor for an acknowledgement message within a time period, and repeat the event message when the acknowledgement message is not received within a time period; and a master controller supported by the structure, connected to the motor and the power supply, and electrically connectable to the remote input device by the electrical conductor, the master controller to receive the event message, communicate the acknowledgement message in response to receiving the event message, and control a power being provided to the motor for moving the garage door.

2. The system of claim 1, wherein the remote input device includes a keypad having a button.

3. The system of claim 2, wherein the device controller monitors for an input from the button and communicates the event message in response to receiving the input.

4. The system of claim 3, wherein the device controller repeats the event message at a time period when the input is continuous for greater than the time period.

5. The system of claim 4, wherein the remote input device includes a second button, wherein the device controller monitors for a second input from the second button, communicates a second event message in response to the second input, monitors for a second acknowledgement message within a second time period, and repeats the second event message when the second acknowledgement message is not received within the second time period.

6. The system of claim 5, wherein the master controller receives the second event message, and communicates the second acknowledgement message in response to receiving the second event message.

7. The system of claim 3, wherein the device controller communicates a heartbeat message when the input is not received within a second time period.

8. The system of claim 7, wherein the device controller repeats the heartbeat message when the input is further not received within a third time period, the second and third time periods being the same length of time.

9. The system of claim 1, wherein the system further comprises a terminal supported by the structure, wherein the structure includes a housing enclosing the motor, power supply, and controller, wherein the remote input device is external to the housing, and wherein the system further comprises the electrical conductor for connecting the remote input device to the terminal.

10. The system of claim 1, wherein the event message is one of a key press message and a key hold message.

11. The system of claim 1, wherein the remote input device includes a light-emitting diode, and wherein the acknowledgement message includes a value for controlling the light-emitting diode.

12. The system of claim 1, wherein the control of the power to the motor is based on the received event message.

13. A method of operating a garage door opener system including a garage door opener and a remote input device electrically connected to the garage door opener, the method comprising:

receiving a power from the garage door opener at the remote input device over the electrical conductor;

communicating an event message over the electrical conductor from the remote input device;

receiving the event message at the garage door opener;

communicating an acknowledgement message in response to receiving the event message;

monitoring for the acknowledgement message within a time period at the remote input device;

repeating the event message when the acknowledgement message is not received within the time period; and controlling a power of the garage door opener for moving a garage door.

14. The method of claim 13, wherein the remote input device includes a keypad having a button, and wherein the method further comprises receiving an input from the button, and wherein the communicates the event message is in response to the receiving for the input.

15. The method of claim 14, and further comprising repeating the event message at a time period when the input is continuous for greater than the time period.

16. The method of claim 14, and further comprising communicating a heartbeat message when the input is not received within a second time period.

17. The method of claim 16, and further comprising repeating the heartbeat message when the input is further not received within a third time period, the second and third time periods being the same length of time.

18. The system of claim 1, wherein the event message is one of a key press message and a key hold message.

19. The method of claim 13, and further comprising controlling a light-emitting diode of the remote input device based on the acknowledgement message.

20. The method of claim 13, wherein the controlling the power of the garage door opener is based on the event message.

* * * * *